US005765569A

United States Patent [19]

Kemanjian

[11] Patent Number: 5,765,569

[45] Date of Patent: Jun. 16, 1998

[54] CIGAR CUTTER

[76] Inventor: Gary Kemanjian, 16015 E. Foothill Blvd., Irwindale, Calif. 91702

[21] Appl. No.: 901,595

[22] Filed: Jul. 28, 1997

Related U.S. Application Data

[60] Provisional application No. 60/033,694 Dec. 20, 1996.

[51] Int. Cl. [6] ..... A24F 13/24

[52] U.S. Cl. ..... 131/248; 131/250

[58] Field of Search ..... 131/248, 233, 131/237, 250; 30/92, 112, 278; D27/195

[56] References Cited

U.S. PATENT DOCUMENTS

| | | | |
|---|---|---|---|
| 589,405 | 9/1897 | Billings | 131/248 |
| 1,598,112 | 8/1926 | Bauaa | 131/233 |
| 4,027,682 | 6/1977 | Halmaghi | 131/233 |

*Primary Examiner*—Aaron J. Lewis
*Assistant Examiner*—Charles W. Anderson
*Attorney, Agent, or Firm*—Beehler & Pavitt

[57] ABSTRACT

An improved cigar cutter capable of cutting a cylindrical plug from the end of a cigar is described. The cigar cutter includes a sharpened cylindrical blade slidably mounted on a cylindrical mandrel. The cylindrical blade has a radial orifice adjacent to its upper end sized to permit a ball bearing to extend partially through the orifice. The mandrel includes a helical groove extending about the circumference of the mandrel. The helical groove is sized to receive a portion of the ball bearing when the cylindrical blade is mounted on the mandrel. A cylindrical cover is provided having an inside diameter only slightly greater than the outside diameter of the cylindrical blade and a rectilinear slot extending downwardly from the top of the cover. The cover slides over the cylindrical blade with the radially outer portion of the protruding ball bearing being seated in the rectilinear slot. At least one spring-loaded pin and matching orifice is provided to retain the cover in position over the cylindrical blade. In use the mandrel is rotated with respect to the cover in a first direction, causing the cylindrical blade to extend from the cover. The blade is then positioned against the end of a cigar and the cutter twisted. Next the mandrel is rotated with respect to the cover in a second, opposite direction, thereby causing the cylindrical blade to be retracted within the cutter and causing the plug of tobacco cut from the cigar to be ejected.

6 Claims, 2 Drawing Sheets

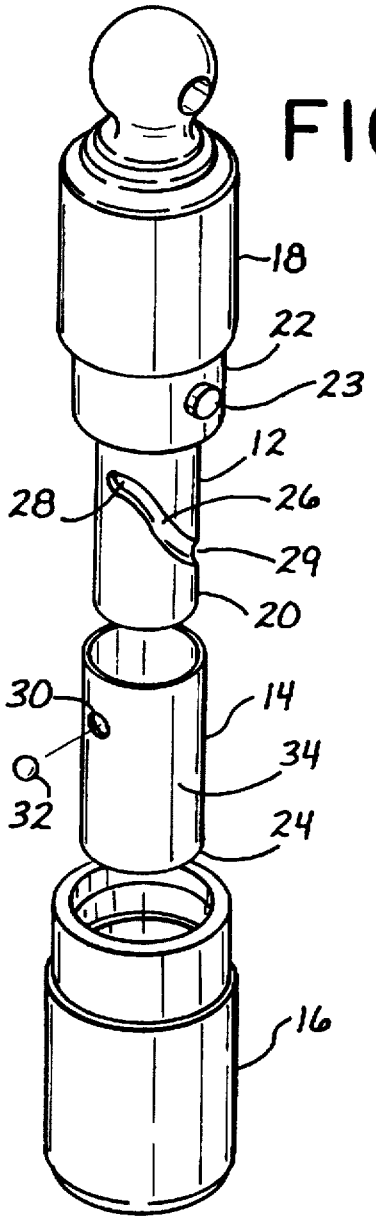
FIG. 1
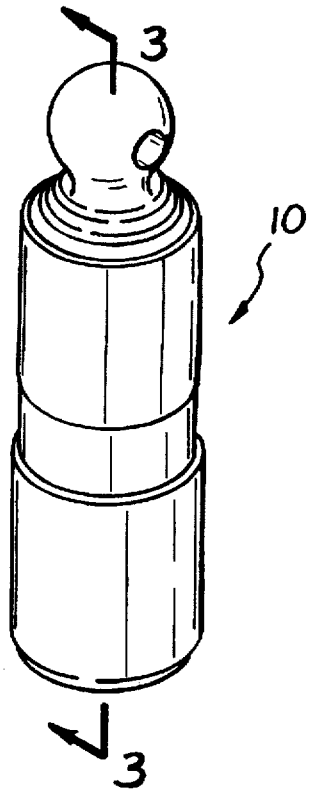
FIG. 2
FIG. 4
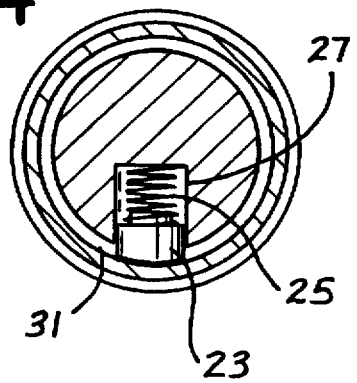
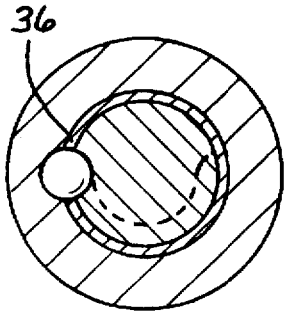
FIG. 5

CIGAR CUTTER

PRIOR APPLICATION

This application is a continuation-in-part of provisional application Ser. No. 60/033,694 now abandoned, filed Dec. 20, 1996.

FIELD OF THE INVENTION

This invention relates to cutting implements, generally, and, particularly, to such implements as are adapted for cutting openings in the end of a cigar which is inserted in the smoker's mouth.

BACKGROUND OF THE INVENTION

Ever since smoking of cigars came into vogue a number of centuries ago, it has been found desirable to cut the end of the cigar which is inserted in the smoker's mouth for a brief distance axially in order to enable the smoker initially to draw air through the wrapped tobacco in order to light the opposite end, and thereafter, to draw the desired smoke axially through the cigar into the smoker's mouth.

In order to provide a suitable opening for this purpose, various instruments have been utilized to cut such an opening. These instruments have ranged from knives, including pen knives, to sophisticated cutters which may cut off or even drill out a short axial opening. Drilling, however, can produce a ragged mouth-end for the cigar and, since one of the pleasures of cigar smoking is having a smooth cigar end inserted in the mouth, drilling and efforts to cut with a pen knife have not been considered satisfactory.

Another type of cutter has been one which may have a cylindrical blade which slides out from a shield into the end of the cigar axially for a short distance to cut a plug which is removed upon withdrawal of the cylindrical cutter. The axial movement of the cutter, however, is usually accomplished through some type of thumb actuated ram which operates against a spring, the purpose of which is to withdraw the cylindrical blade upon release of the thumb's force against the other end of the ram. While this type of cutter can be effective, at least initially, cutting becomes more difficult when the blade becomes duller, since the blade is simply forced axially against the tobacco packed inside the cigar wrapper. It has also been found that occasionally cutters driven by rams can damage the end of the cigar against which they are placed because of the force exerted by both the blade and its supporting element.

While other more sophisticated cutters have been devised, some of them have been quite complicated in construction and operation and quite expensive to manufacture, with the result that they may price themselves out of range of the average cigar smoker.

It has also been a concern of persons using certain of these cutters to avoid having the cutting blade scrape or dig into, the user's finger or thumb. Provision must be made, therefore, to shield a cutting blade to prevent possible injury either before, during, or after use of the cutter.

SUMMARY OF THE INVENTION

The present invention avoids the problems with prior art cigar cutters by providing a rotating cylindrical cutter blade. Such rotation is accomplished by mounting the cutter blade on a mandrel having at least a partial helical groove in its outer wall, which groove extends at least partially about the circumference of the mandrel. A ball bearing is seated in the upper end of the helical groove in the mandrel, which ball bearing extends radially outwardly of the mandrel. The cylindrical cutter blade is orificed near its upper end, such orifice being of a size sufficient to permit a substantial part of the ball bearing to protrude through the wall of the cutter blade. A cylindrical cover having an inside diameter only slightly greater than the outside diameter of the cylindrical blade and a rectilinear slot partially extending downwardly from the top of the cover toward the bottom of the cover, is then slipped over the cylindrical blade mounted on the mandrel with the radially outer portion of the protruding ball bearing being seated in the rectilinear slot. The upper end of the mandrel extending above that portion having an axial length equal to that of the cylindrical cutter blade, may be expanded to provide a gripping area which may be rotated. A shoulder may be interposed between the gripping area and portion of the mandrel on which the cutter blade is supported, said shoulder having an inside diameter such that it fits rotatably within the upper portion of the cylindrical cover. This shoulder may be radially orificed to receive and retain one or more spring-biased radially outwardly extending pins adapted to fit into a circumferential receiving groove formed inside the upper end of the cylindrical cover.

To assemble the cigar cutter of the present invention, the cylindrical knife is slipped over the mandrel with the ball bearing being inserted through the blade orifice to seat at the upper end of the helical recess in the mandrel. The cover is then slipped over the thus mounted blade with its rectilinear slot receiving a portion of the outwardly projecting bearing. The cover is then secured in position by bringing it up over the shoulder above the blade receiving portion of the mandrel to where its projecting pin may be slipped into the circumferential groove within the upper end of the cylindrical cover.

As thus constructed and assembled, it will be found that when the upper portion of the mandrel beyond its shoulder is rotated relative to the cylindrical cover, the cylindrical blade will be rotated about the mandrel and moved axially downwardly out of the cover through the movement of the bearing in the helical groove, while the cover is maintained axially in a fixed position. Such axial movement results from the portion of the ball bearing disposed in the cover's rectilinear slot moving only axially. As the blade is thus rotated, it will be projected axially below the cover, so that if the cover is placed on or against an end of the cigar, the rotation and axial movement of the blade will cut a cylindrical plug axially in the end of the cigar. Such plug may be drawn out of the end of the cigar by moving the cutter axially away from the cigar end, and the plug may then be discarded by retracting the blade onto the mandrel, within the cylindrical cover. As the cylindrical cutter moves axially back onto the mandrel, the closed end of the mandrel will force out from the cutter the tobacco plug which may have been removed from the cigar end by the cutter.

DESCRIPTION OF THE DRAWINGS

In the accompanying drawings,

FIG. 1 is an exploded perspective view of the several components of the cutter of the present invention.

FIG. 2 is a perspective view similar to FIG. 1, but showing the components assembled into operating position.

FIG. 4 is a section taken on the line 4—4 of FIG. 3 looking in the direction of the arrows.

FIG. 5 is a section taken on the line 5—5 of FIG. 3 looking in the direction of the arrows.

DESCRIPTION OF THE PREFERRED EMBODIMENT

Figure 7:
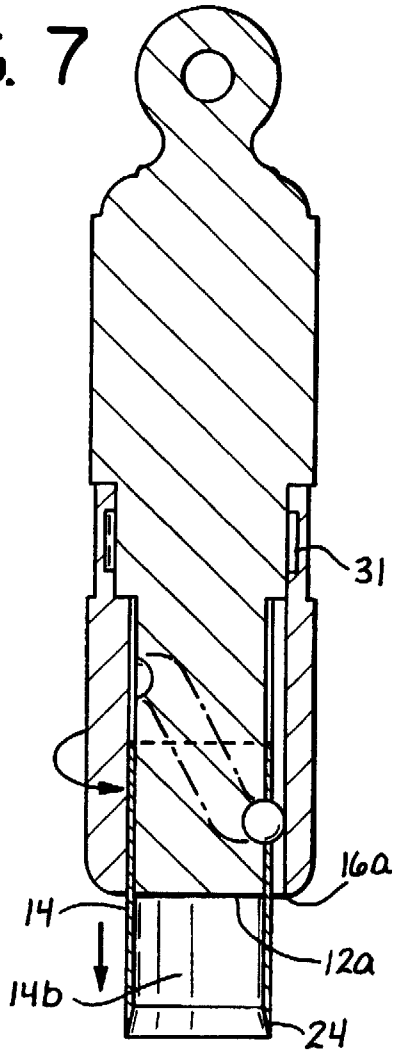
FIG. 7 is a sectional view similar to FIG. 6, but showing the final destination of the cylindrical cutter as the ball bearing has moved to the lowermost point of the helical slot in the mandrel.

Referring to FIGS. 1 and 2 of the drawings, the cutter 10 is an assembly of a mandrel portion 12, a cylindrical cutter blade 14 and a cylindrical cover 16. The mandrel portion 12 may include an upper gripping section 18, a blade supporting section 20 and an intermediate shoulder section 22. The lower edge 24 of the blade 14 is sharpened. The blade supporting section 20 of the mandrel is helically grooved 10 at 26, with such groove extending from upper end 28 down to a lower end 29. The cylindrical blade 14 is circularly orificed at 30, such orifice having a diameter just sufficient to allow a portion of the ball bearing 32 to pass through the wall 34 of the blade section 14. The helical groove 26 is configured to allow a portion of the ball bearing 32 to move from the upper end 28 of the groove down to the lower end 29. 15 The upper end 28 and the lower end 29 of the groove 26 desirably should be shallower than the remainder of the groove. Thereby, the ball bearing 32 will bind when forced into either end 28, 29 and effectively "lock"the blade 14 in such end to prevent inadvertent axial movement of the blade 14, as for example, out of the cover when the cutter is in a user's pocket. The cover section 16, preferably, has an inside diameter just sufficiently greater than the outside diameter of the blade section 14 to allow the blade section 14 to rotate within the cover section 16. Inside the cover section 16 is an axially extending rectilinear slot 36 which is configured to permit the portion of the ball bearing 32 which extends beyond the blade section wall 34 to ride up and down in the slot 36.

In order to prevent the cutter assembly 10 from being disassembled, a radial recess 27 is provided in the shoulder 23 of the mandrel 12. A pin 23 is disposed in the recess 27 against a spring 25 which is first seated in the recess and tends to force the pin radially outwardly. When the cover 16 is slipped over the blade 14 and mandrel 12 up over the shoulder 22, the pin 23 will be forced by the spring 25 into a circumscribing groove 31 in the upper inside wall of the cover 16, thereby locking the mandrel 12 and cover 16 against axial disengagement.

Figure 6:
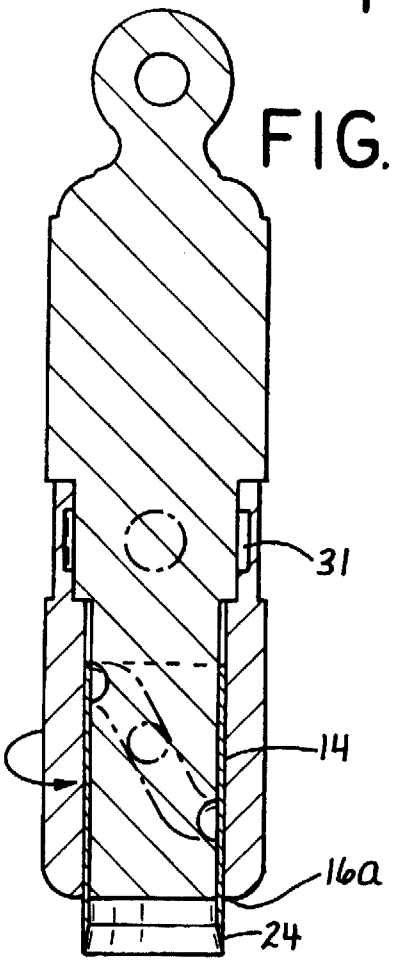
FIG. 6 is a section similar to FIG. 3 showing the effect of the initial movement of the ball bearing in the helical slot of the mandrel.
Figure 3:
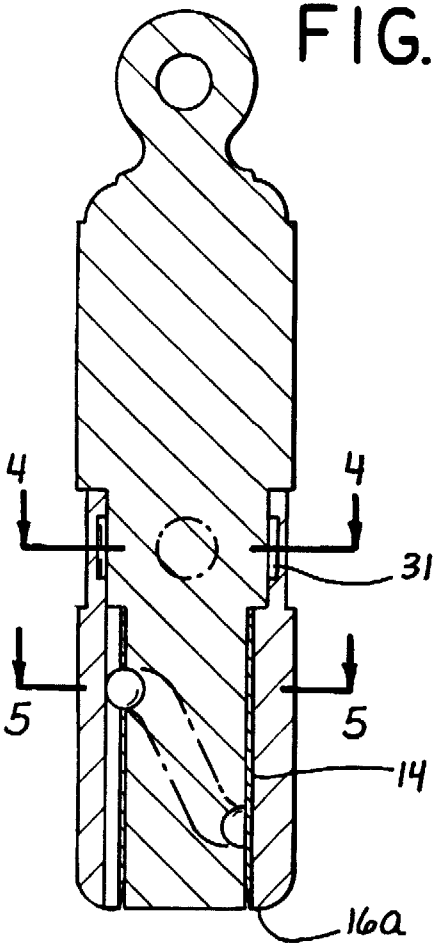
FIG. 3 is a section taken on the line 3—3 of FIG. 2 looking in the direction of the arrows.

In operation, after the several components illustrated in FIG. 1 and described above have been assembled to produce the unit shown in FIG. 2, rotation of the mandrel 12 while the cover 16 is firmly gripped in the user's fingers in a clockwise manner will result in the rotation of the cutter blade 14 to follow the course of the helical groove 26 through movement of the ball bearing 32 in the helical groove 26. When the cutting blade 14 thus follows the helical groove 26, it will be found to not only rotate, but move downwardly out of the lower end **16*a* of the cover section 16 in the manner illustrated in FIGS. 6 and 7. This rotation and downward movement results from the fact that the portion of the ball bearing 32 which extends radially outwardly through the orifice 30 in the cutter blade 14 is disposed in the rectilinear axially extending groove 36 and, since the cover section 16 is held firmly against any rotation by the user's fingers, turning the upper portion 18 of the mandrel causes the blade 14 to follow the helical path 26, thereby to move the lower end 24 of the cylindrical blade 14 down and out of the end 16*a* of the cover section 16. Since the lower end 12*a* of the mandrel section 12 is closed by a planar surface (not shown), when the upper portion of the mandrel 18 is turned in a counter-clockwise direction, any tobacco plug (also not shown) from the cigar end which has been cut and is captured by the blade end 24 will be ejected from the cylindrical passage 14*b* defined by that portion of the blade which has been projected beyond the mandrel end 12*a***.

From the foregoing description, it may be seen that the cigar cutter of the present invention comprises only three major parts which are easily assembled and, once assembled, may not be disassembled.

The cutter of the present invention will be found to be easy to operate and most reliable and effective in cutting end plugs from a cigar.

I claim:

1. An improved cigar cutter, comprising:

a hollow cylindrical cutter blade, said blade being of a predetermined length and having an upper end and a lower end, an inner surface and an outer surface, said lower end having a sharpened circular cutting edge;

a mandrel having a first end and a second end, a blade supporting section extending upward from the second end, an intermediate section extending axially upward from the blade supporting section, and a gripping section extending axially upward from the intermediate section;

said cutter blade being slidably disposed on the blade supporting section of said mandrel to move between a first position in which the lower end of the cutter blade coincides with the second end of the mandrel and a second position in which the lower end of the cutter blade extends axially beyond the second end of the mandrel for a predetermined distance;

a cylindrical cover coaxially disposed over said cutter blade and having a top end and a bottom end, said cutter blade being slidable within the cover and in its first position having its lower end coterminal with the second end of the mandrel and the bottom end of the cover;

rotatable means to move the cutter blade from its first position to its second position and back to its first position; and means for retaining said cover on said mandrel.

2. An improved cigar cutter as described in claim 1, wherein said rotatable cutter moving means further comprises:

a ball bearing;

said ball bearing comprising first, second, and third portions about a ball diameter;

a circular orifice extending radially through the cutter blade adjacent its upper end, said orifice having a diameter just sufficient to permit the first portion and the second portion of the ball bearing when disposed in the orifice to extend radially outward;

the blade supporting section of the mandrel including a helical groove extending from the first end to the second end of the mandrel, said groove being sized to receive the third portion the ball bearing;

said cover having a first inner surface adjacent its top end having an upper end and a lower end, and a second inner surface adjacent its bottom end having an upper end and a lower end;

said second inner surface of said cover having a vertical rectilinear groove extending from the upper end of the second inner surface down to a point adjacent the bottom end of said cover;

said vertical groove being sized to receive the first portion of said ball bearing extending through said orifice in said cutter blade opposite the third portion;

said ball bearing being movably disposed in said helical groove, said cutter blade being disposed upon said blade supporting section of the mandrel with the second portion of said ball bearing extending through said cylindrical orifice, and said cover being disposed upon said cutter blade with the first portion of the ball bearing being movably disposed within the vertical groove;

the cutter blade being extendable beyond the lower end of the cover when the mandrel is rotated with respect to said cover in a first direction, to positioning the cutter blade so that it may be rotated against an end of a cigar to cut a plug therefrom; and the cutter blade being withdrawn within and coincident with the cover when the mandrel is rotated in a second direction opposite the first direction, thereby ejecting the cut tobacco plug from the lower end of the cutter blade.

3. An improved cigar cutter as described in claim 1, wherein said cover retaining means further comprises:

an annular groove adjacent the upper end of said first inner surface of said cover;

at least one radial hole extending at least partially into the intermediate section of the mandrel;

a spring disposed within said hole;

at least one pin sized to fit slidably within said hole;

said pin having an inner end and an outer end and being disposed within said hole and compressing said spring; and the top end of the cover being disposed to extend over the intermediate section of the mandrel with its annual groove seating said spring biasing pin, thereby preventing the cover from sliding downwardly over the cutter and off of the mandrel.

4. An improved cigar cutter as described in claim 2 wherein said rotatable cutter moving means further comprises:

an annular extension of the upper end of said helical groove serving to secure said cutter in a fully withdrawn position within said cover; and an annular extension of said lower end of said helical groove serving to secure said cutter in a fully extended position from said cover.

5. An improved cigar cutter as described in claim 1, wherein the gripping section of the mandrel includes an outer gripping surface; and the cover includes an outer gripping surface.

6. An improved cigar cutter as described in claim 1, wherein the first end of said mandrel includes a means for attaching the cigar cutter to a keyring, watch chain, or similar device.

* * * * *